US005267935A

United States Patent [19]

Bialek et al.

[11] Patent Number: 5,267,935

[45] Date of Patent: Dec. 7, 1993

[54] FOLDING DEVICE FOR A WEB-FED ROTARY PRINTING MACHINE

[75] Inventors: Herbert Bialek, Neckargemünd; Hans Müller, Leimen, both of Fed. Rep. of Germany

[73] Assignee: Heidelberg Druckmaschinen Aktiengesellschaft, Heidelberg, Fed. Rep. of Germany

[21] Appl. No.: 978,780

[22] Filed: Nov. 19, 1992

[30] Foreign Application Priority Data

Dec. 4, 1991 [DE] Fed. Rep. of Germany ... 9115031[U]

[51] Int. Cl.[5] ..... B41F 13/58; B65H 45/18

[52] U.S. Cl. ..... 493/444; 493/445; 74/52

[58] Field of Search ..... 493/427, 444, 445, 468, 493/476; 74/52

[56] References Cited

U.S. PATENT DOCUMENTS 4,509,939 4/1985 Müller ..... 493/444

5,171,204 12/1992 Müller ..... 493/444

FOREIGN PATENT DOCUMENTS 3046051 6/1982 Fed. Rep. of Germany .

*Primary Examiner*—William E. Terrell

*Attorney, Agent, or Firm*—Nils H. Ljungman & Associates

[57] ABSTRACT

It is the object of the invention to provide a simple folding device rotating at high speed, the folding device producing a longitudinal fold without any sliding guidance device or reverse-motion device, and in which during the folding the folding blade executes a movement of stroke, perpendicular in every direction, towards the printed copy.

19 Claims, 3 Drawing Sheets

20
21
33
28
34
26
27
23
17
16
18
12
25
9
10
6
7
30
29
8
11
19
35
24
13
14
15
22
4
1
1
2
2
5

FOLDING DEVICE FOR A WEB-FED ROTARY PRINTING MACHINE

BACKGROUND OF THE INVENTION

1. Field of the Invention

The invention relates to a folding device for a web-fed rotary printing machine for producing a longitudinal fold in the conveying direction of the printed copies, the longitudinal fold being formed after the cylinder crossfold. The device comprises a folding blade provided parallel to the conveying direction and suspended from two drive cranks rotating at the same speed and being disposed parallel to each other with the axes of the crank pins extending transversely to the conveying direction, and from two additional cranks assigned thereto. The additional cranks impart to the folding blade an up-and-down movement. When in its bottom position, the folding blade thrusts the printed copies between two driven folding rollers. The crank radius r1 of the drive crank corresponds to the crank radius r2 of the additional crank, and the additional crank is co-axially mounted on the crank pin of the drive crank. The additional crank is able to be driven, via gears, at the same speed as the drive crank, however, in opposite direction of rotation thereto, such that the crank pin of the additional crank executes a rectilinear, perpendicular stroke.

2. Background Information

The German Laid Open Patent Application No. DE 30 46 051 C2, which corresponds to U.S. Pat. No. 4,509,939, issued Apr. 9, 1985, entitled "Folding Device for Web-fed Rotary Printing Presses", discloses a device of this type, a folding device using two double cranks driven by a planetary gear having a sun gear with internal toothing such that the folding blade executes a stroke, which is perpendicular in every direction, towards the printed copy. The mechanical efforts required to execute this movement are high.

OBJECT OF THE INVENTION

It is the object of the invention to provide a simple folding device, rotating at high speed, the folding device for producing a longitudinal fold, without any sliding means of guidance, or reverse-motion means. During the folding, the folding blade executes a movement of stroke, perpendicular in every direction, towards the printed copy.

SUMMARY OF THE INVENTION

This object is achieved by the inventive features described herein. This solution has the advantage that the folding blade decelerates the velocity of the printed copies by using simple gear parts and thrusts the printed copies perpendicularly between the folding rollers, thus preventing any lateral sliding motion whatsoever from acting on the printed copy, since such lateral sliding would result in a misaligned or laterally offset fold. This is achieved independently of the respective machine speed, in other words such a folding operation can be achieved essentially independently of the respective speed of execution of the printing machine, with the copies being rectangularly aligned in a known manner. Moreover, according to the present invention the folding device has a purely rotative function, doing without sliding means or means permitting a reversal of motion, and the folding device may be designed such that the folding blade executes a certain stroke.

Also described herein are advantageous embodiments of the inventive subject matter which may be carried out without requiring great technical efforts.

One aspect of the invention resides broadly in a rotary printing press having an apparatus for folding a sheet of paper, the sheet of paper being conveyed in a direction of travel within the rotary printing press, the printing press including a web moving in the direction of travel for conveying the sheet of paper, the apparatus comprising: a folding blade; and a pair of transmission devices for moving the folding blade in a periodic reciprocating motion substantially at a right angle to the directional of travel; each of the transmission devices comprising: a first axle having a first rotational axis; a first crank member, the first crank member being attached to the first axle to rotate with the first axle, the first crank member extending outward from the first rotational axis, and the first crank member being provided with a first rotational bearing, the distance between the center of the first rotational bearing and the first rotational axis being $r_1$; a second axle having a second rotational axis, the second axle being rotationally mounted in the first rotational bearing; a first gear, the first gear being stationary; a second gear, the second gear being attached to the second axle to rotate with the second axle; a transmission element having: a first portion engaging the first gear, and a second portion engaging the second gear, the first portion being configured to revolve about the first gear, and the second portion being rigidly connected to the first portion; and a second crank member, the second crank member being attached to the second axle to rotate with the second axle, the second crank member extending outward from the second rotational axis, the second crank member having a pivotal attachment device, and the second crank member being pivotally attached to a portion of the folding blade by the pivotal attachment device, the distance between the center of the pivotal attachment device and the second rotational axis being $r_2$.

Another aspect of the invention resides broadly in an apparatus for folding a sheet of paper in a printing press, the sheet of paper being conveyed in a direction of travel within a rotary printing press, the printing press including a web moving in the direction of travel for conveying the sheet of paper, the apparatus comprising: a folding blade; and a pair of transmission devices for moving the folding blade in a periodic reciprocating motion substantially at a right angle to the direction of travel; each of the transmission devices comprising: a first axle having a first rotational axis; a first crank member, the first crank member being attached to the first axle to rotate with the first axle, the first crank member extending outward from the first rotational axis, and the first crank member being provided with a first rotational bearing, the distance between the center of the first rotational bearing and the first rotational axis being $r_1$; a second axle having a second rotational axis, the second axle being rotationally mounted in the first rotational bearing; a first gear, the first gear being stationary; a second gear, the second gear being attached to the second axle to rotate with the second axle; a transmission element having: a first portion engaging the first gear, and a second portion engaging the second gear, the first portion being configured to revolve about the first gear, and the second portion being rigidly connected to the first portion; and a second crank member, the second crank member being attached to the second axle to rotate with the second axle, the second crank member extending outward from the second rotational axis, the second crank member having a pivotal attachment device, and the second crank member being pivotally attached to a portion of the folding blade by the pivotal attachment device, the distance between the center of the pivotal attachment device and the second rotational axis being $r_2$.

Yet another aspect of the invention resides broadly in an apparatus for folding a sheet of paper in a printing press, the sheet of paper being conveyed in a direction of travel within a rotary printing press, the printing press including a web moving in the direction of travel for conveying the sheet of paper, the apparatus comprising: a folding blade; and a pair of transmission devices for moving the folding blade in a periodic reciprocating motion substantially at a right angle to the direction of travel; each of the transmission devices comprising: a first axle having a first rotational axis; a first crank member, the first crank member being attached to the first axle to rotate with the first axle, the first crank member extending outward from the first rotational axis, and the first crank member being provided with a first rotational bearing, the distance between the center of the first rotational bearing and the first rotational axis being $r_1$; a second axle having a second rotational axis, the second axle being rotationally mounted in the first rotational bearing; a sun gear, the sun gear being stationary and the sun gear being substantially concentric with the first axle; a planetary gear, the planetary gear being rotationally mounted on the first crank member, the planetary gear being disposed to revolve about the sun gear as the first crank member rotates about the first rotational axis, the planetary gear being disposed to engage the sun gear, and the planetary gear being configured to rotate as the planetary gear revolves about the sun gear; a second gear, the second gear being attached to the second axle to rotate with the second axle, the second gear being disposed to revolve about the sun gear as the first crank member rotates about the first rotational axis, the second gear being disposed to engage the planetary gear, and the second gear being configured to rotate as the planetary gear rotates; and a second crank member, the second crank member being attached to the second axle to rotate with the second axle, the second crank member being configured to rotate with the second gear, the second crank member extending outward from the second rotational axis, the second crank member having a pivotal attachment device, and the second crank member being pivotally attached to a portion of the folding blade by the pivotal attachment device, the distance between the center of the pivotal attachment device and the second rotational axis being $r_2$; the sun gear having a first diameter; the second gear having a second diameter; the second diameter being substantially half of the first diameter; the sun gear, the planetary gear, the second gear, the first axle, the second axle, the first crank member and the second crank member being configured to move the folding blade through one cycle of the periodic reciprocating motion during one revolution of the first axle.

BRIEF DESCRIPTION OF THE DRAWINGS

A specimen embodiment of the invention is schematically illustrated in the drawings, in which.

DESCRIPTION OF THE PREFERRED EMBODIMENTS

Figure 1:
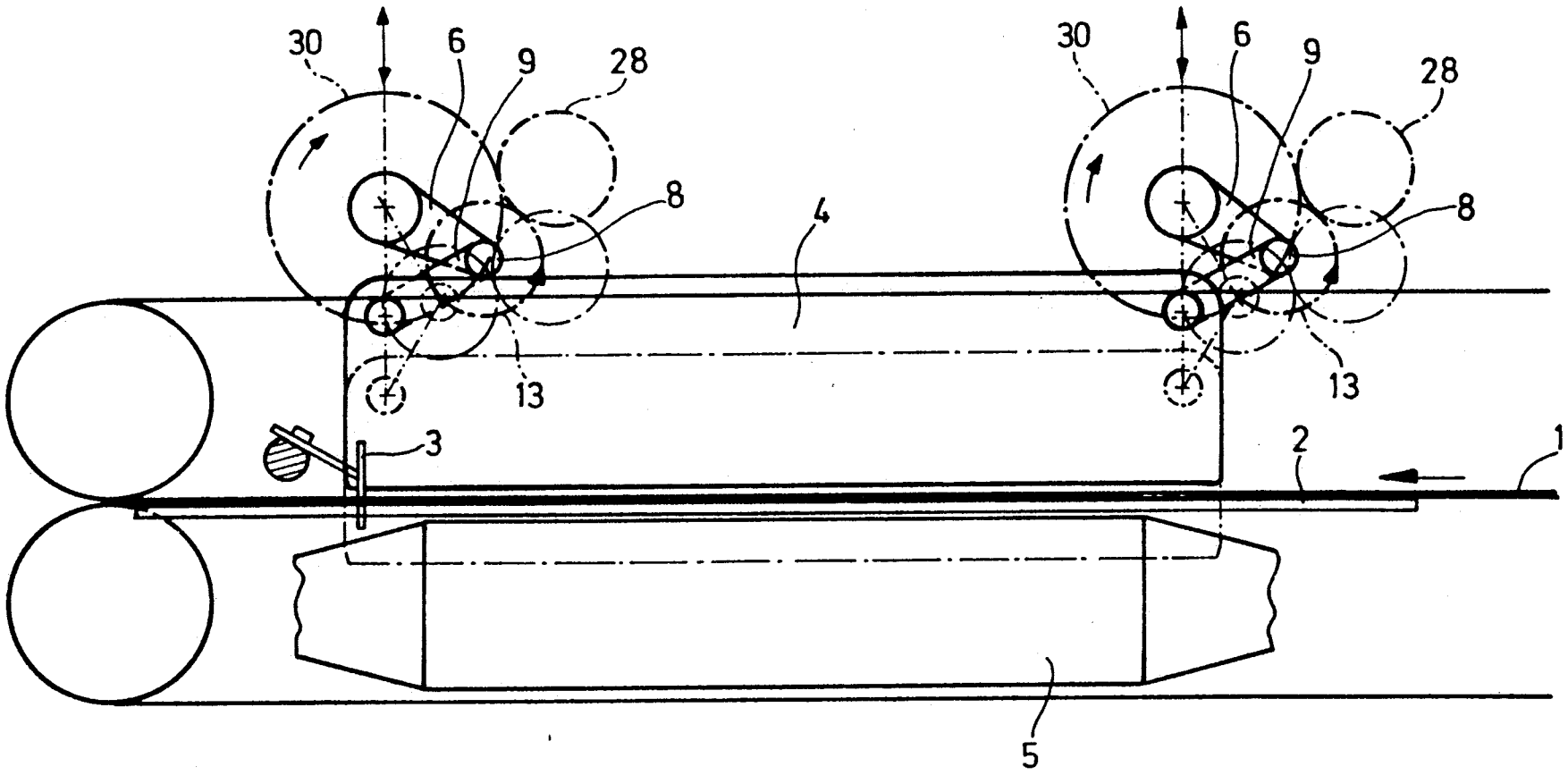
FIG. 1 is a side view of the folding device.

In a known manner the product to be folded is conveyed over a folding table 2 via a tape 1, and is thrust between folding rollers 5 by a folding blade 4, possibly after having experienced a smooth aligning contact with stops 3. The folding rollers 5 then convey the product to be folded in a downward direction. In so doing, the point of time of impact of the folding blade 4, and thus the point of time of the folding, may be adjusted in a known manner, for example, by adjusting the phase relationship of the folding blade 4 with respect to the folded product.

Figure 2:
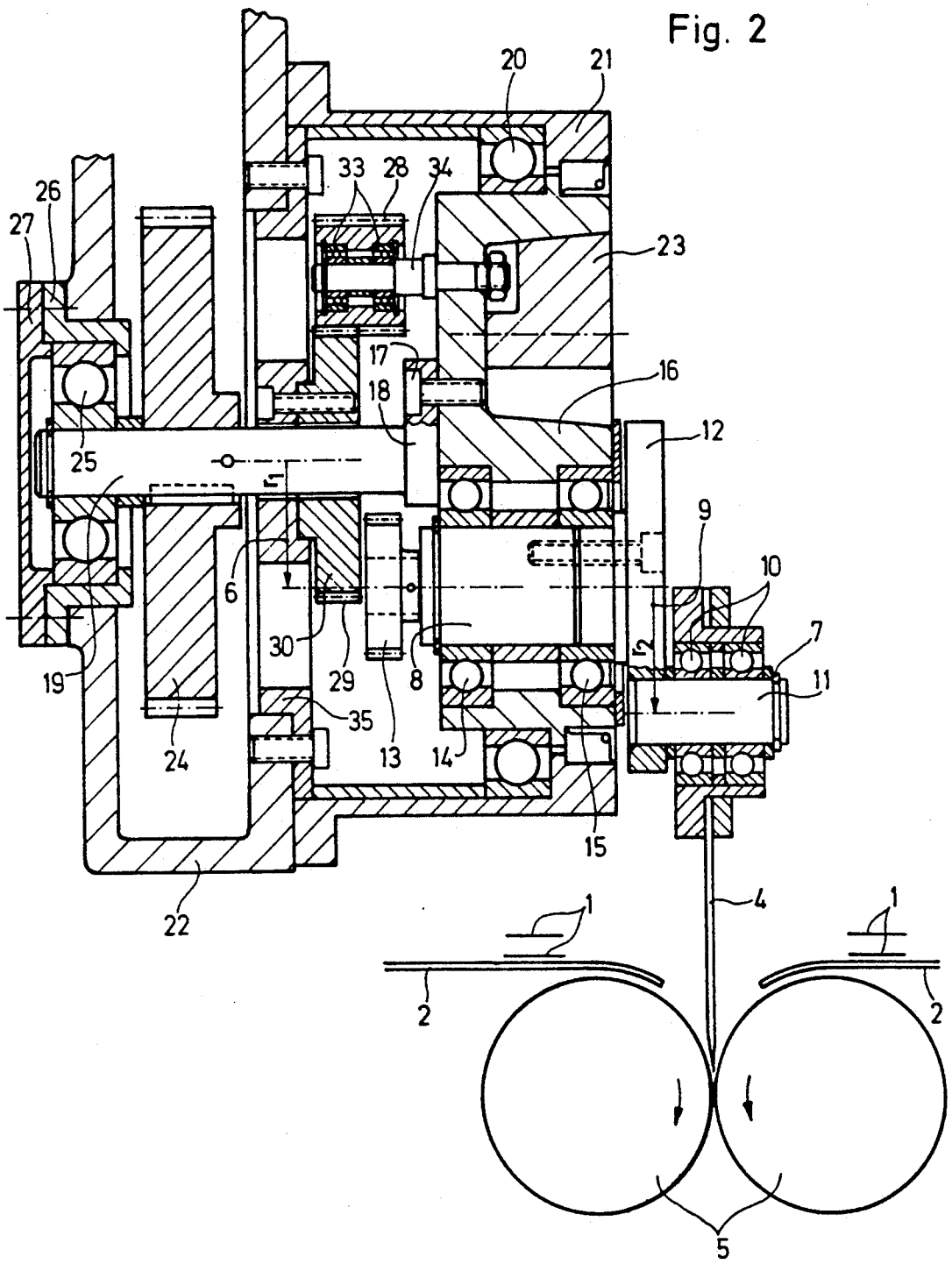
FIG. 2 is a partial cross-sectional view of the folding blade control.

The up-and-down movement of the folding blade 4 can be realized by two drive cranks 6 (FIG. 1). On each of the drive cranks 6 a trunnion 8 of an additional crank 9 is preferably mounted (FIG. 2). Via ball bearings 10 the folding blade 4 can be mounted on a crank pin 11, firmly connected to the additional crank 9, and preferably laterally secured by means of a retaining ring 7. The additional crank 9 carries a counterweight 12 for mass balancing.

In other words, the folding blade 4 can be mounted on crank pins 11, preferably such that the the crank pins 11 are free to rotate relative to the folding blade 4. Each crank pin 11 preferably is mounted on one of the additional cranks 9. The trunnion 8 of each additional crank 9 is preferably mounted on one of the drive cranks 6, preferably such that the trunnion 8 is free to rotate relative to the drive crank 6. The folding blade 4 is moved up and down by moving the crank pins 11 up and down. Each crank pin 11 is preferably moved up and down by rotating the drive crank 6 and the additional crank 9 in opposite directions. The additional crank 9 preferably rotates about the trunnion 8 as the trunnion 8, which is mounted on the drive crank 6, revolves in the opposite direction about the axis of rotation of the drive crank 6.

A gearwheel 13 can be mounted on the trunnion 8 of the additional crank 9. Via ball bearings 14, 15 the trunnion 8 itself is preferably mounted in a counter-bearing 16 which can be fastened to the rotary body 18 of the drive crank 6 by means of screws 17. The counter-bearing 16, in turn, can be mounted in a bearing holder 21 concentrically with respect to a drive pin 19 of the drive crank 6 via a ball bearing 20. The bearing holder 21, in turn, can be fastened to supporting means 22. The counter-bearing 16 can also be provided with a counterweight 23 for mass balancing.

In other words, the counter-bearing 16 can preferably be rigidly attached to the drive crank 6. The counter-bearing 16 therefore can move with the drive crank 6 and may be considered to be a part of the drive crank 6. The trunnion 8 is preferably mounted in the counter-bearing 16 such that the trunnion 8 is free to rotate relative to the counter-bearing 16. The gearwheel 13 is preferably mounted on the trunnion 8 in a rigid manner such that the gearwheel 13 is not free to rotate relative to the trunnion 8.

As shown in the specimen embodiment of FIG. 2, the drive crank 6 can be driven by a drive gear 24 fastened to the drive pin 19, and the drive pin 19 can be mounted in the supporting means 22 via a second ball bearing 25.

The ball bearing 25 can be held laterally via a bearing holder 26 and a cover 27.

In other words, in at least one embodiment, the drive crank 6 may itself be driven by a drive gear 24 via the drive pin 19. The drive crank 6 and the drive gear 24 are preferably not free to rotate relative to the drive pin 19. The drive pin 19 may be mounted in the supporting means 22 such that the drive pin 19 is free to rotate relative to the supporting means 22.

When the drive gear 24 is set in rotation, the trunnion 8 of the additional crank 9, in connection with the counter-bearing 16 and the ball-bearing 15, drives the gearwheel 13 such that, via an intermediate gearwheel 28, it is connected to the external toothing 29 of a sun gear 30 mounted stationarily and concentrically with respect to the drive pin 19. The sun gear 30 is preferably fastened to a bearing body 35 screwed to the supporting means 22.

Figure 3:
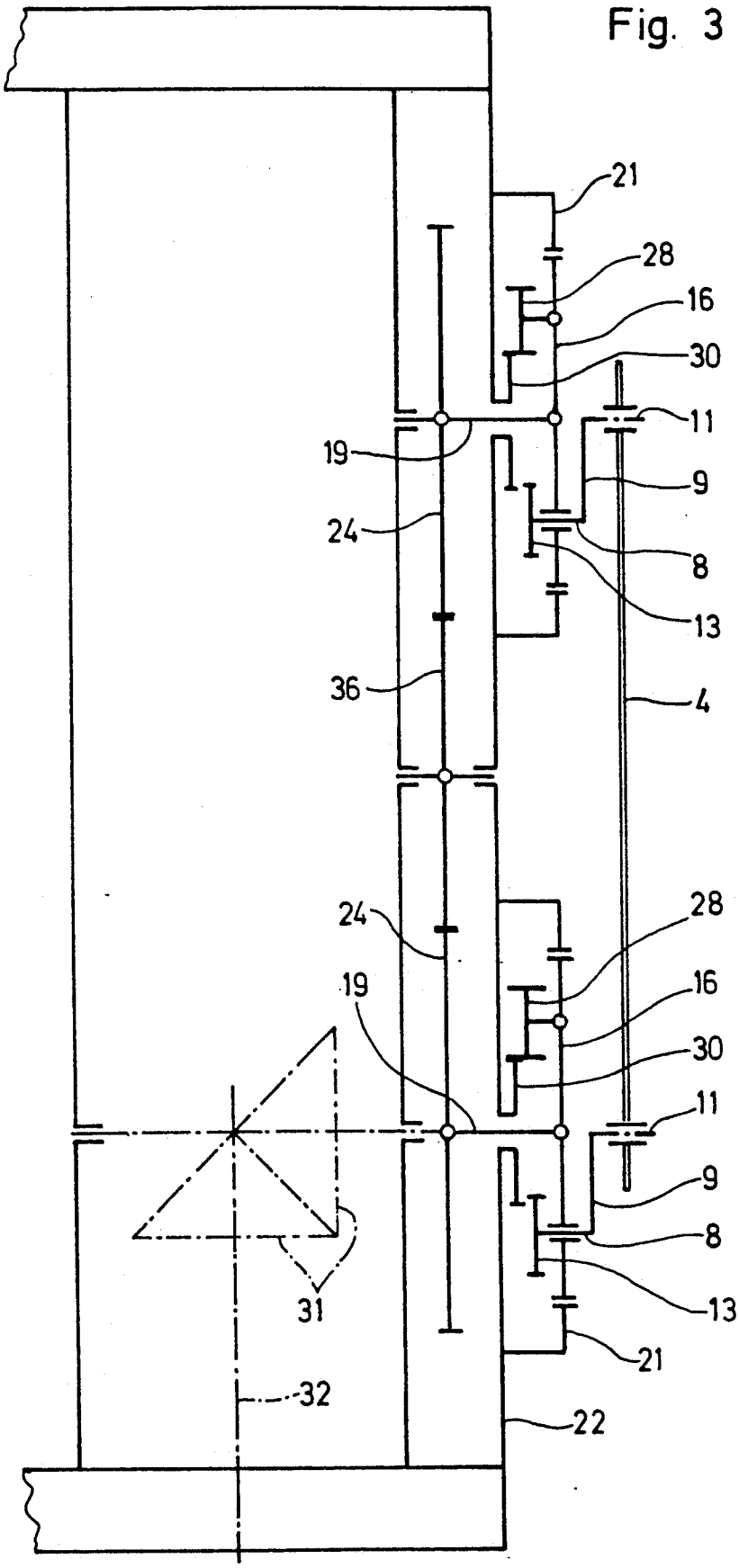
FIG. 3 is a top view of the drive scheme for the folding blade.

In other words, when the drive gear 24 is rotated, the drive crank 6, which is preferably driven by the drive gear 24 via the drive pin 19, and the counter-bearing 16, which is preferably rigidly connected to the drive crank 6, both rotate also. The drive gear 24, the drive pin 19, the drive crank 6 and the counter-bearing 16 preferably rotate as a single unit. Since the trunnion 8 is preferably mounted in the counter-bearing 16, the rotation of the counter-bearing 16 along with the drive crank 6 causes the trunnion 8 to revolve around the axis of rotation of the drive crank 6, the axis of rotation of the drive crank 6 preferably being the axis of rotation of the drive pin 19. The gearwheel 13, which is preferably rigidly connected to the trunnion 8, therefore also revolves around the axis of rotation of the drive crank 6. As is shown in FIG. 1, the gearwheel 13 is preferably engaged by the intermediate gearwheel 28 in at least one embodiment of the invention. FIG. 2 and FIG. 3 do not necessarily show the engagement between the gearwheel 13 and the intermediate gear 28, possibly to better show the relationships among other elements. The gearwheel 13 might be engaged by the intermediate gear 28 either directly or indirectly. The intermediate gearwheel 28 also preferably engages the external toothing 29 of the sun gear 30. The sun gear 30 is preferably fixed to a bearing body 35, which is in turn preferably fixed to the supporting means 22. The sun gear 30 is therefore preferably completely stationary and does not rotate, while the intermediate gearwheel 28 revolves about the sun gear 30.

In the specimen embodiment shown, the diameter of the external toothing 29 corresponds to double the diameter of the toothing of the gearwheel 13. The crank radii r1 and r2 of the drive crank 6 and the additional crank 9, respectively, correspond to the radius of the external toothing 29 in the specimen embodiment shown. The rotary motion of the gearwheel 13 can thereby be directed in an opposite direction to the rotary motion of the drive gear 24. The gearwheel 13 and the sun gear 30 are disposed so as to be axially offset with respect to each other. The width of the intermediate gearwheel 28 can be designed such that both gearwheels 13, 30 are in meshing contact therewith. The intermediate gearwheel 28 is preferably mounted on ball bearings 33 provided on a bolt 34, the bolt being secured in the counter-bearing 16. The intermediate gearwheel 28 and the gearwheel 13 rotate with the counter-bearing 16. The intermediate gearwheel 28 is accommodated, free from play, with respect to both the gearwheel 13 and the sun gear 30.

In other words, both the intermediate gearwheel 28 and the gearwheel 13 are preferably mounted on the counter-bearing 16, preferably such that both the intermediate gearwheel 28 and the gearwheel 13 are free to rotate relative to the counter-bearing 16. The intermediate gearwheel 28 is preferably mounted via the bolt 34 and the ball bearings 33. The gearwheel 13 is preferably mounted via the trunnion 8. As the counter-bearing 16 rotates, both the intermediate gearwheel 28 and the gearwheel 13 are preferably carried along. Preferably the intermediate gearwheel 28 and the gearwheel 13 are mounted such that the intermediate gearwheel 28 remains engaged to the gearwheel 13 and to the external toothing 29 of the sun gear 30 as the counter-bearing 16 rotates. Preferably, if the counter-bearing 16 rotates in one direction, say clockwise, then since the counter-bearing 16 carries the intermediate gearwheel 28, the intermediate gearwheel 28 revolves clockwise around the sun gear 30. Since the intermediate gearwheel 28 engages the stationary sun gear 30, the intermediate gearwheel 28 is preferably forced to rotate in the same clockwise direction. This clockwise rotation of the intermediate gearwheel 28 then essentially causes the gearwheel 13 to rotate in a counterclockwise direction because of the engagement of the gearwheel 13 with the intermediate gearwheel 28.

In FIG. 1 the drive cranks 6 move, for example, clockwise (arrow) and the additional cranks 9 move counterclockwise. In the position indicated by an unbroken line the folding blade 4 is disposed slightly above the folding table 2. Following the rotary motion of the drive crank 6 the next position indicated by a broken line is shortly before the bottom dead center, i.e. the drawing shows the point of time right before the folding rollers 5 grip the folded product. Thus, in the specimen embodiment of the folding device, the entire stroke of the folding blade 4 corresponds precisely to double the length of the radii r1 and r2. With the transmission ratio between the sun gear 30 and the gearwheel 13 being 2:1 the crank pin 11 of the additional crank 9 moves precisely rectilinearly, perpendicularly and centrically with respect to the drive pin 19. Thus, the folding blade 4 can execute a rectilinear, perpendicular stroke. In the specimen embodiment illustrated the drive crank 6 performs one revolution per folding cycle.

In other words, when the drive crank 6, and therefore the counter-bearing 16 carrying the intermediate gearwheel 28 and the gearwheel 13, rotate clockwise, the additional crank 9, which is rigidly connected to the gearwheel 13 via the trunnion 8, preferably rotates counterclockwise, thus producing the up-and-down motion of the folding blade 4. In the specimen embodiment, the stroke of the folding blade 4 is preferably twice the sum of the radii r1 and r2. The transmission ratio of 2:1 between the sun gear 30 and the gearwheel 13 may be required to cause the gearwheel 13, and therefore the additional crank 9, to rotate at the same rate but in the opposite direction as the drive crank 6. The intermediate gearwheel 28, which preferably rotates in the same direction as the drive crank 6, tends to cause the gearwheel 13 to rotate in the opposite direction, due to the engagement of the intermediate gearwheel 28 and the gearwheel 13. Countering this effect is the fact that the gearwheel 13 is at the same time revolving as the gearwheel 13 is carried along by the counter-bearing 16. For a transmission ratio of 1:1, the two effects may exactly cancel and the gearwheel 13 may not rotate at all relative to the sun gear.

The scheme of FIG. 3 shows the two drive gears 24 connected to each other via a spur gear 36. The lower drive pin 19 is connected to a drive shaft 32, for example, via a couple of bevel gears 31. The phase position of the drive shaft 32 is able to be varied in a known manner. Thus, the folding blade 4 can be adjusted with respect to the folded copy so that the point of time at which the products are folded can be precisely adjusted.

One feature of the invention resides broadly in the folding device for a web-fed rotary printing machines for producing a longitudinal fold in the conveying direction of the printed copies, the longitudinal fold being formed after the cylinder crossfold, the device comprising a folding blade being disposed parallel to the conveying direction and suspended from two drive cranks—rotating at the same speed and being provided parallel to each other, with the axes of the crank pins extending transversely to the conveying direction—and from two additional cranks assigned thereto, the additional cranks imparting to the folding blade an up-and-down movement, when being in its bottom position the folding blade thrusts the printed copies between two driven folding rollers, with the crank radius r1 of the drive crank corresponding to the crank radius r2 of the additional crank, and with the additional crank being co-axially mounted on the crank pin of the drive crank, and being able to be driven, via gears, at the same speed as the drive crank, however, in opposite direction of rotation thereto, such that the crank pin of the additional crank executes a rectilinear, perpendicular stroke, characterized in that the trunnion 8 of the additional crank 9 carries a spur gear 13 rolling, via an intermediate gearwheel 28 rotating with the trunnion 8, on an external toothing 29 of a sun gear 30 which is mounted concentrically and stationarily with respect to the drive pin 19 of the drive crank 6.

Another feature of the invention resides broadly in the folding device characterized in that the spur gear 13 provided on the trunnion 8 of the additional crank 9 has a diameter which is half the diameter of the stationarily mounted sun gear 30, that the spur gear 13 and the sun gear 30 are disposed so as to be axially offset with respect to each other, and that the drive pin 19 of the drive crank 6 performs one revolution per folding cycle.

Still another feature of the invention resides broadly in the folding device characterized in that the trunnion 8 and the intermediate gearwheel 28 is mounted in a counter-bearing 16 connected to the drive pin 19.

Yet another feature of the invention resides broadly in the folding device, characterized in that, via a spur gear 36, the drive gears 24 are connected to each other on the two drive pins 19 of the drive cranks 6, and that they are adjustable in their phase relationship with respect to the folded copy.

Another feature of the invention resides broadly in the folding device, characterized in that the drive crank 6 and the additional crank 9 carry counterweights 12, 23 provided opposite the crank pins 8, 11.

U.S. patent application Ser. No. 07/768,376, filed Sep. 27, 1991, which has been allowed, entitled "Printing Press with Apparatus for Folding Printed Paper", which corresponds to German Laid Open Patent Application No. DE-OS 40 31 298, describe a folding device for web-fed rotary printing presses, and are hereby incorporated by reference as if set forth in its entirety. Hans Müller is the inventor in U.S. patent application Ser. No. 07/768,376, and is one of the joint inventors in the present application. Both applications have been assigned to Heidelberger Druckmaschinen Aktiengesellschaft.

All, or substantially all, of the components and methods of the various embodiments may be used in any combination with at least one embodiment or all of the embodiments, if any, described herein.

All of the patents, patent applications and publications recited herein and in the attached declaration, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A rotary printing press having an apparatus for folding a sheet of paper, the sheet of paper being conveyed in a direction of travel within the rotary printing press, the printing press including a web moving in the direction of travel for conveying the sheet of paper, said apparatus comprising:

a folding blade; and a pair of transmission means for moving said folding blade in a periodic reciprocating motion substantially at a right angle to the direction of travel;

each of said transmission means comprising:

a first axle having a first rotational axis;

a first crank member, said first crank member being attached to said first axle to rotate with said first axle, said first crank member extending outward from said first rotational axis, and said first crank member being provided with a first rotational bearing, the distance between the center of said first rotational bearing and said first rotational axis being $r_1$;

a second axle having a second rotational axis, said second axle being rotationally mounted in said first rotational bearing;

a first gear, said first gear being stationary;

a second gear, said second gear being attached to said second axle to rotate with said second axle;

a transmission element having:

a first portion engaging said first gear, and a second portion engaging said second gear, said first portion being configured to revolve about said first gear, and said second portion being rigidly connected to said first portion; and a second crank member, said second crank member being attached to said second axle to rotate with said second axle, said second crank member extending outward from said second rotational axis, said second crank member having pivotal attachment means, and said second crank member being pivotally attached to a portion of said folding blade by said pivotal attachment means, the distance between the center of said pivotal attachment means and said second rotational axis being $r_2$.

2. The rotary printing press according to claim 1, wherein:

said first gear comprises a sun gear with external toothing;

said transmission element comprises a planetary gear; and said planetary gear is disposed to engage said sun gear and to revolve about said sun gear, said planetary gear being configured to rotate as said planetary gear revolves about said sun gear.

3. The rotary printing press according to claim 2, wherein said planetary gear is rotationally mounted on said first crank member.

4. The rotary printing press according to claim 3, wherein said sun gear and said first axle are substantially concentric.

5. The rotary printing press according to claim 4, wherein:

said sun gear has a first diameter;

said second gear has a second diameter;

said second diameter is substantially half of said first diameter; and said sun gear, said planetary gear, said second gear, said first axle, said second axle, said first crank member and said second crank member are configured to move said folding blade through one cycle of said periodic reciprocating motion during one revolution of said first axle.

6. The rotary printing press according to claim 5, wherein: said first crank member comprises a bearing holder; said bearing holder is disposed to rotate with said first axle;

said first rotational bearing is disposed in said bearing holder; and said planetary gear is rotationally mounted on said bearing holder.

7. The rotary printing press according to claim 6, wherein said second gear and said sun gear are offset from one another in the direction of said first rotational axis.

8. The rotary printing press according to claim 7, wherein:

said first crank member comprises a first counterweight for balancing said first crank member;

said second crank member comprises a second counterweight for balancing said second crank member;

each of said transmission means further comprises a drive gear, said drive gear being connected to said first axle to rotate with said first axle;

said apparatus further comprises a spur gear; and said spur gear engages said drive gear of each said transmission means;

said spur gear and said drive gear of each of said transmission means being configured to allow adjustment of the phase relationship with respect to said periodic reciprocating motion of said folding blade between said drive gear of one of said transmission means and said drive gear of the other of said transmission means.

9. The rotary printing press according to claim 8, wherein:

said apparatus further comprises a housing;

said sun gear is substantially fixedly attached to said housing;

each of said transmission means further comprises a second rotational bearing, said second rotational bearing being disposed in said housing;

said first axle has a first end and a second end;

said first crank member is attached to said first end of said first axle;

said second end of said first crank member is rotationally mounted in said second rotational bearing;

each of said transmission means further comprises a third rotational bearing, said third rotational bearing being disposed in said housing;

said bearing holder is rotationally mounted in said third rotational bearing;

said pivotal attachment means of said second crank member comprises a fourth rotational bearing; and said distance $r_1$ and said distance $r_2$ are substantially identical.

10. Apparatus for folding a sheet of paper in a printing press, the sheet of paper being conveyed in a direction of travel within a rotary printing press, the printing press including a web moving in the direction of travel for conveying the sheet of paper, said apparatus comprising:

a folding blade; and a pair of transmission means for moving said folding blade in a periodic reciprocating motion substantially at a right angle to the direction of travel;

each of said transmission means comprising:

a first axle having a first rotational axis;

a first crank member, said first crank member being attached to said first axle to rotate with said first axle, said first crank member extending outward from said first rotational axis, and said first crank member being provided with a first rotational bearing, the distance between the center of said first rotational bearing and said first rotational axis being $r_1$;

a second axle having a second rotational axis, said second axle being rotationally mounted in said first rotational bearing;

a first gear, said first gear being stationary;

a second gear, said second gear being attached to said second axle to rotate with said second axle;

a transmission element having:

a first portion engaging said first gear, and a second portion engaging said second gear, said first portion being configured to revolve about said first gear, and said second portion being rigidly connected to said first portion; and a second crank member, said second crank member being attached to said second axle to rotate with said second axle, said second crank member extending outward from said second rotational axis, said second crank member having pivotal attachment means, and said second crank member being pivotally attached to a portion of said folding blade by said pivotal attachment means, the distance between the center of said pivotal attachment means and said second rotational axis being $r_2$.

11. The apparatus for folding a sheet of paper according to claim 10, wherein:

said first gear comprises a sun gear with external toothing;

said transmission element comprises a planetary gear; and said planetary gear is disposed to engage said sun gear and to revolve about said sun gear, said planetary gear being configured to rotate as said planetary gear revolves about said sun gear.

12. The apparatus for folding a sheet of paper according to claim 11, wherein said planetary gear is rotationally mounted on said first crank member.

13. The apparatus for folding a sheet of paper according to claim 12, wherein said sun gear and said first axle are substantially concentric.

14. The apparatus for folding a sheet of paper according to claim 13, wherein:

said sun gear has a first diameter;

said second gear has a second diameter;

said second diameter is substantially half of said first diameter; and said sun gear, said planetary gear, said second gear, said first axle, said second axle, said first crank member and said second crank member are configured to move said folding blade through one cycle of said periodic reciprocating motion during one revolution of said first axle.

15. The apparatus for folding a sheet of paper according to claim 14, wherein:

said first crank member comprises a bearing holder;

said bearing holder is disposed to rotate with said first axle;

said first rotational bearing is disposed in said bearing holder; and said planetary gear is rotationally mounted on said bearing holder.

16. The apparatus for folding a sheet of paper according to claim 15, wherein said second gear and said sun gear are offset from one another in the direction of said first rotational axis.

17. The apparatus for folding a sheet of paper according to claim 16, wherein:

said first crank member comprises a first counterweight for balancing said first crank member;

said second crank member comprises a second counterweight for balancing said second crank member;

each of said transmission means further comprises a drive gear, said drive gear being connected to said first axle to rotate with said first axle;

said apparatus further comprises a spur gear; and said spur gear engages said drive gear of each said transmission means;

said spur gear and said drive gear of each of said transmission means being configured to allow adjustment of the phase relationship with respect to said periodic reciprocating motion of said folding blade between said drive gear of one of said transmission means and said drive gear of the other of said transmission means.

18. The apparatus for folding a sheet of paper according to claim 17, wherein:

said apparatus further comprises a housing;

said sun gear is substantially fixedly attached to said housing;

each of said transmission means further comprises a second rotational bearing, said second rotational bearing being disposed in said housing;

said first axle has a first end and a second end;

said first crank member is attached to said first end of said first axle;

said second end of said first crank member is rotationally mounted in said second rotational bearing;

each of said transmission means further comprises a third rotational bearing, said third rotational bearing being disposed in said housing;

said bearing holder is rotationally mounted in said third rotational bearing;

said pivotal attachment means of said second crank member comprises a fourth rotational bearing; and said distance $r_1$ and said distance $r_2$ are substantially identical.

19. Apparatus for folding a sheet of paper in a printing press, the sheet of paper being conveyed in a direction of travel within a rotary printing press, the printing press including a web moving in the direction of travel for conveying the sheet of paper, said apparatus comprising:

a folding blade; and a pair of transmission means for moving said folding blade in a periodic reciprocating motion substantially at a right angle to the direction of travel;

each of said transmission means comprising:

a first axle having a first rotational axis;

a first crank member, said first crank member being attached to said first axle to rotate with said first axle, said first crank member extending outward from said first rotational axis, and said first crank member being provided with a first rotational bearing, the distance between the center of said first rotational bearing and said first rotational axis being $r_1$;

a second axle having a second rotational axis, said second axle being rotationally mounted in said first rotational bearing;

a sun gear with external toothing, said sun gear being stationary and said sun gear being substantially concentric with said first axle;

a planetary gear, said planetary gear being rotationally mounted on said first crank member, said planetary gear being disposed to revolve about said sun gear as said first crank member rotates about said first rotational axis, said planetary gear being disposed to engage said sun gear, and said planetary gear being configured to rotate as said planetary gear revolves about said sun gear;

a second gear, said second gear being attached to said second axle to rotate with said second axle, said second gear being disposed to revolve about said sun gear as said first crank member rotates about said first rotational axis, said second gear being disposed to engage said planetary gear, and said second gear being configured to rotate as said planetary gear rotates; and a second crank member, said second crank member being attached to said second axle to rotate with said second axle, said second crank member being configured to rotate with said second gear, said second crank member extending outward from said second rotational axis, said second crank member having pivotal attachment means, and said second crank member being pivotally attached to a portion of said folding blade by said pivotal attachment means, the distance between the center of said pivotal attachment means and said second rotational axis being $r_2$;

said sun gear having a first diameter;

said second gear having a second diameter;

said second diameter being substantially half of said first diameter;

said sun gear, said planetary gear, said second gear, said first axle, said second axle, said first crank member and said second crank member being configured to move said folding blade through one cycle of said periodic reciprocating motion during one revolution of said first axle.

* * * * *